US006634547B2

(12) United States Patent
Willis

(10) Patent No.: US 6,634,547 B2
(45) Date of Patent: Oct. 21, 2003

(54) FOLDING CUP THAT FITS INTO A CUP HOLDER

(76) Inventor: Thomas Willis, 59 O'Brien Ct., Williston, VT (US) 05495

( * ) Notice: Subject to any disclaimer, the term of this patent is extended or adjusted under 35 U.S.C. 154(b) by 16 days.

(21) Appl. No.: 09/881,634

(22) Filed: Jun. 14, 2001

(65) Prior Publication Data

US 2002/0014524 A1 Feb. 7, 2002

Related U.S. Application Data

(60) Provisional application No. 60/211,413, filed on Jun. 14, 2000.

(51) Int. Cl.[7] ..... B65D 5/36

(52) U.S. Cl. ..... 229/405; 229/117.05; 229/400; 229/906

(58) Field of Search ..... 229/117.05, 117.06, 229/400, 405, 902, 906

(56) References Cited

U.S. PATENT DOCUMENTS 1,690,586 A * 11/1928 Main ..... 229/117.05
2,027,802 A * 1/1936 Wood ..... 229/400
2,127,631 A * 8/1938 Nagle ..... 229/400
3,268,143 A * 8/1966 Bolcato ..... 229/400
3,272,418 A * 9/1966 Morse et al. ..... 229/400
3,684,157 A * 8/1972 Mendez ..... 229/117.05
4,210,271 A * 7/1980 Dutcher ..... 229/400
4,267,955 A * 5/1981 Struble ..... 229/117.05
4,552,293 A * 11/1985 Blagg et al. ..... 229/400
5,492,269 A * 2/1996 Sung ..... 229/117.06
6,053,403 A * 4/2000 Cai ..... 229/400

* cited by examiner

*Primary Examiner*—Gary E. Elkins
(74) *Attorney, Agent, or Firm*—Eric R. Benson, Esq.

(57) ABSTRACT

A new, novel and useful folding cup that fits into a cup holder. The cup is designed to fit into an array of cup holders such as the cup holders that are often built into modern motor vehicles in an arm rest or dash of such an automobile. The cup may be made from paperboard as a paperboard blank or any other suitable material that may be formed into a collapsible or expandable configuration wherein the bottom panels form a generally circular shape which may include a polygonal configuration. When the cup is in the folded condition, the cup is in a generally flat condition for economy of storage and shipping. By squeezing opposite edges of the flat structure the cup expands such that its bottom takes on its generally circular shape which may include a polygonal configuration and the top opens to accept whatever substance will be placed in the cup. This new, novel and useful folding cup that fits in a cup holder may be used as a container for french fries, chicken pieces or bread sticks, etc. sold at many restaurants with drive through "to go" food services.

11 Claims, 6 Drawing Sheets

FOLDING CUP THAT FITS INTO A CUP HOLDER

This is a provisional of application No. 60/211,413 filed on Jun. 14, 2000.

BACKGROUND OF THE INVENTION

Field of the Invention

The present invention relates to a new, novel and useful folding cup that fits in a cup holder. This invention relates to folding cups and especially to cups that fit into cup holders, such as those that are built into automobiles, and the like. Conical, scoop-type cups are well known in the art. Reference can be made to any of the U.S. Pat. No. 4,185,764 to Cote, U.S. Pat. No. 4,199,097 to Christensson, U.S. Pat. No. 4,267,955 to Struble, U.S. Pat. No. 4,410,129 to Wisclowson, U.S. Pat. No. 4,718,595 to Jones, U.S. Pat. No. 4,792,086 to Chen et al., U.S. Pat. No. 5,351,879 to Liu et al. as representative prior art.

Although several of these patents disclose a flat, folded, and expandable carton for storing dry food products, none are designed to be held within a cup holder, commonly found in today's motor vehicles. There is presently a need for a paperboard type container that fits within a cup holder. The current art available and in widespread use around the world in ready to eat prepared food product delivery to customers requires that the consumer balance the container, often precariously within the motor vehicle as many try to eat from the container while driving. The containers often spill and cause accidents by causing the operator of the vehicle to try and "save" his food before it spills as it slides off the dash or other surface where it may be placed when taking a corner perhaps or stopping abruptly as in traffic. Still other consumers will place the container between their legs to prevent it from sliding and inasmuch as these containers often contain deep-fried foods, such as french fries and chicken pieces, the consumer using the container in this way will often grease stain their garments. There has been a long felt need for such a folding cup design that fits into a cup holder, thus eliminating the afore-mentioned spillages and garment staining.

As the prior art suggests, folding cups are most often made of paperboard, although the current invention may be made of any suitable material. The prior art also discloses that folding cups are generally composed by a single sheet of paperboard material which is then folded to a generally flat envelope with flat sides which expand and open the container to receive a product for use when the edges of the flat sides are squeezed together by the individual usually filling the container or preparing the container to an open manner for pre-filling storage. The folding cup bottom of the prior art is generally too wide to fit into a traditional cup holder including those cup holders used in modern automobiles where these products are often used and their contents consumed. Modern automobile cup holders are placed in a number of locations within these vehicles and are designed such that a driver and passengers alike may securely fit and retrieve cups and/or beverage containers from the holder with ease and safety. The prior art containers that are suitable for storage of fast food items like french fries or chicken pieces provide the necessary top opening width for access to the products with a human hand, however, they provide no means to be securely stored within a designed cup holder. The present invention may be securely placed within a cup holder and yet maintains a feature of having a top opening that is comparable in width to the prior art preserving access to the products in the container by a human hand which feature is not present in the prior art non-collapsible or non-folding round bottom paper cup designs.

The present invention is capable of being practiced in a variety of sizes suitable for the packaging and pricing needs of the vendor. The folding cup design regardless of the volume of the container will still possess a generally circular bottom which may include a polygonal configuration which is capable of being securely fitted in a cup holder such as those found in automobiles.

Unlike the prior art paper cups with circular bottoms the present invention folds to a generally flat condition for ease of compact storage thus minimizing storage and shipping costs while still incorporating the scooping bell mouth feature for ease of loading and access to products contained therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims once filed.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting in any way the scope of this invention or claims which will be made in a fill patent application to follow.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions and methods insofar as they do not depart from the spirit and scope of the present invention.

Further, the purpose of the foregoing abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the present invention to provide a folding cup that fits in a cup holder apparatus which has many of the advantages of the folding cup designs mentioned heretofore and many novel features that result in a folding cup that fits in a cup holder, such as an automobile cup holder, which are not anticipated, rendered obvious, suggested, or even implied by any of the prior art folding cup or folding containers, either alone or in any combination thereof.

It is another object of the present invention to provide a new and novel folding cup that fits in a cup holder which may be easily and efficiently manufactured, taught and marketed.

It is a further object of the present invention to provide a new and novel folding cup that fits in a cup holder which is of a durable and reliable construction and method.

An even further object of the present invention is to provide a new and novel folding cup that fits in a cup holder which is susceptible of a low cost of manufacture with regard to both materials and labor, and which accordingly is then susceptible of low prices of sale to the consuming public, thereby making such folding cup that fits in a cup holder economically available to the buying public.

Still yet another object of the present invention is to provide a new and novel folding cup that fits in a cup holder which provides in the apparatuses and methods of the prior art some of the advantages thereof, while simultaneously overcoming some of the disadvantages normally associated therewith.

These together with other objects of the invention, along with the various features of novelty which characterize the invention, will be pointed out with particularity in the claims once the full application is filed. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other that those set forth above will become apparent when consideration is given to the following detailed description thereof Such description makes reference to the annexed drawings wherein.

Figure 1:
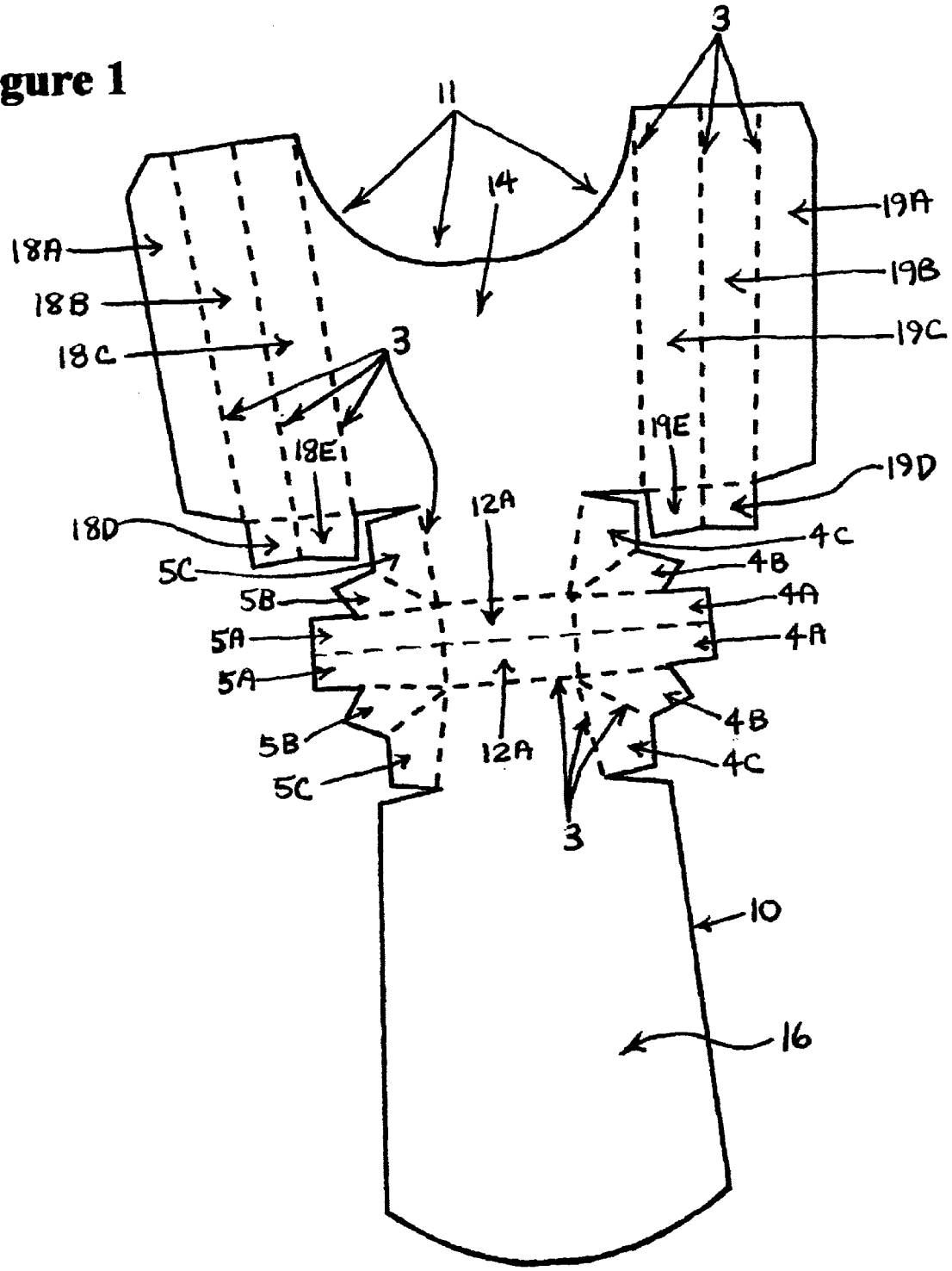
FIG. 1 is a planar view of the most preferred embodiment of the inventive cup in an unfolded condition.
Figure 1A:
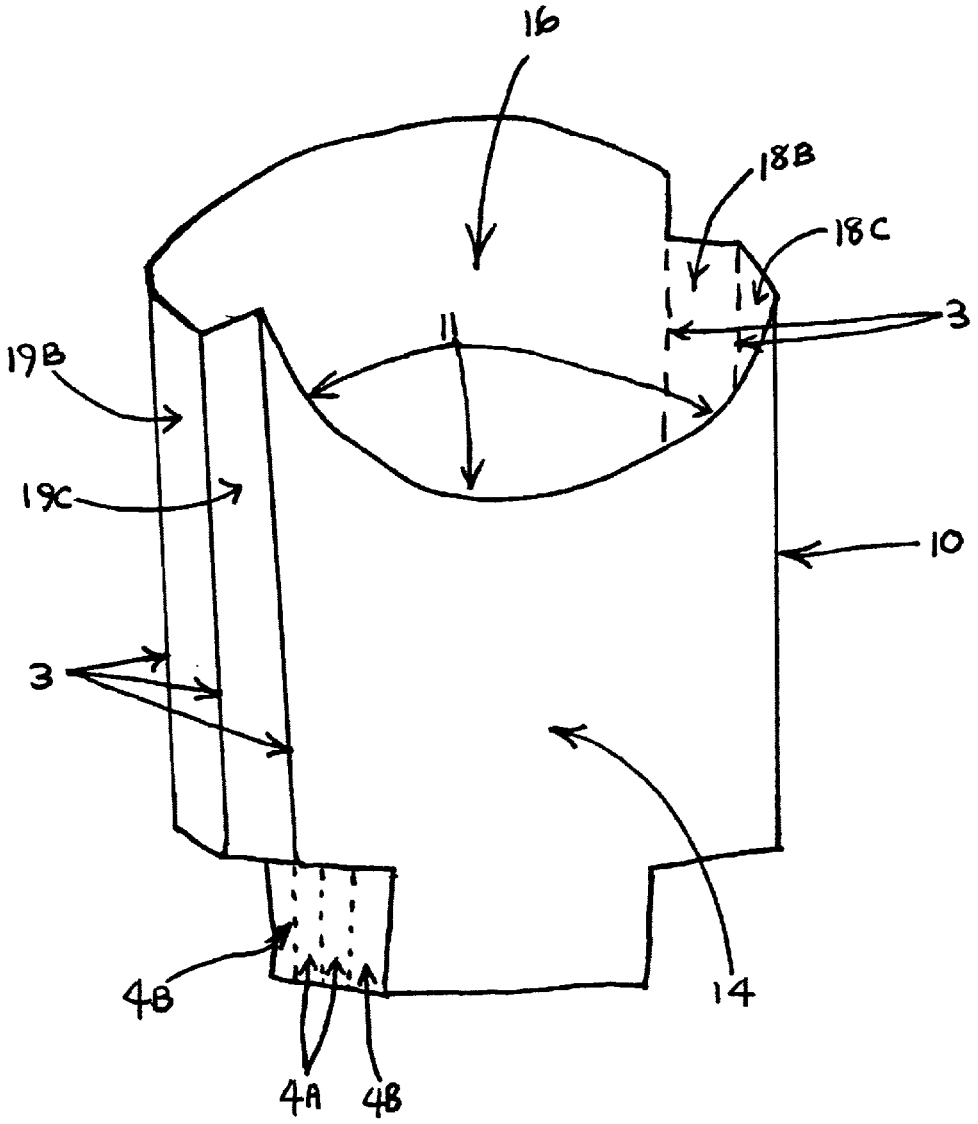
FIG. 1A is a perspective view of the most preferred embodiment shown in FIG. 1 of the inventive cup in an expanded open cup shaped condition.

In the most preferred embodiment as depicted in FIG. 1 and FIG. 1A, and generally designated by the numeral 10, one or more blanks of suitable material cut into the relative size and shape of the inventive cup 10 therein depicted are folded upon the scored fold lines 3 depicted in FIG. 1 and FIG. 1A as dashed lines and the edge panels 18A and 19A of the end wall panels 18B, 18C & 19B, 19C respectively and front and back side wall panels 14 & 16 respectively are attached to one another forming a folded cup 10 that fits in a cup holder. The folding cup 10 that fits in a cup holder's bottom is comprised of two bottom panels 12A and is formed by folding along the scored fold lines 3 and by attachment of the end wall panels 18B, 18C & 19B, 19C to the front and back side wall panels 14 & 16 respectively as described above which in turn further defines upon folding, the now when folded generally perpendicular bottom wall panels 4A, 4B, 4C and 5A, 5B, 5C. Bottom wall panels 4A and 5A in turn form a support for end wall bottom tabs 18D, 18E & 19D, 19E respectively such that the end wall bottom tabs 18D, 18E & 19D, 19E when folded and in this supported position are generally perpendicular to the end wall panels 18B, 18C & 19B, 19C respectively. The generally circular or polygonal bottom formed by the two bottom panels 12A is collapsible along the scored fold lines 3 and once the end wall panels 18B, 18C & 19B, 19C of the collapsed folding cup 10 are squeezed together, the folding cup 10 expands forming an opening 11 and a generally circular or polygonal bottom is formed by the two bottom panels 12A of a size that will fit in a cup holder, such as those in use in automobiles.

The most preferred embodiment as depicted in FIG. 1 in its open or expanded condition as depicted in FIG. 1A is of hollow, conical configuration, having an open bell-mouth 11 at one end, and a closed generally circular or polygonal bottom comprised of two bottom panels 12A at the opposite end. The folding cup 10 further includes opposed front and back side wall panels 14 and 16 respectively which are interconnected by means of opposed end wall panels 18B, 18C & 19B, 19C and overlying and being bonded to the opposed edges of the back side wall panel 16. As shown in FIG. 1 and FIG. 1A, the bell mouth opening 11 of the folding cup 10 facilitates the access to product, such as food items, and the generally circular or polygonal bottom comprised of the two bottom panels 12A facilitates the use in a cup holder.

Figure 2:
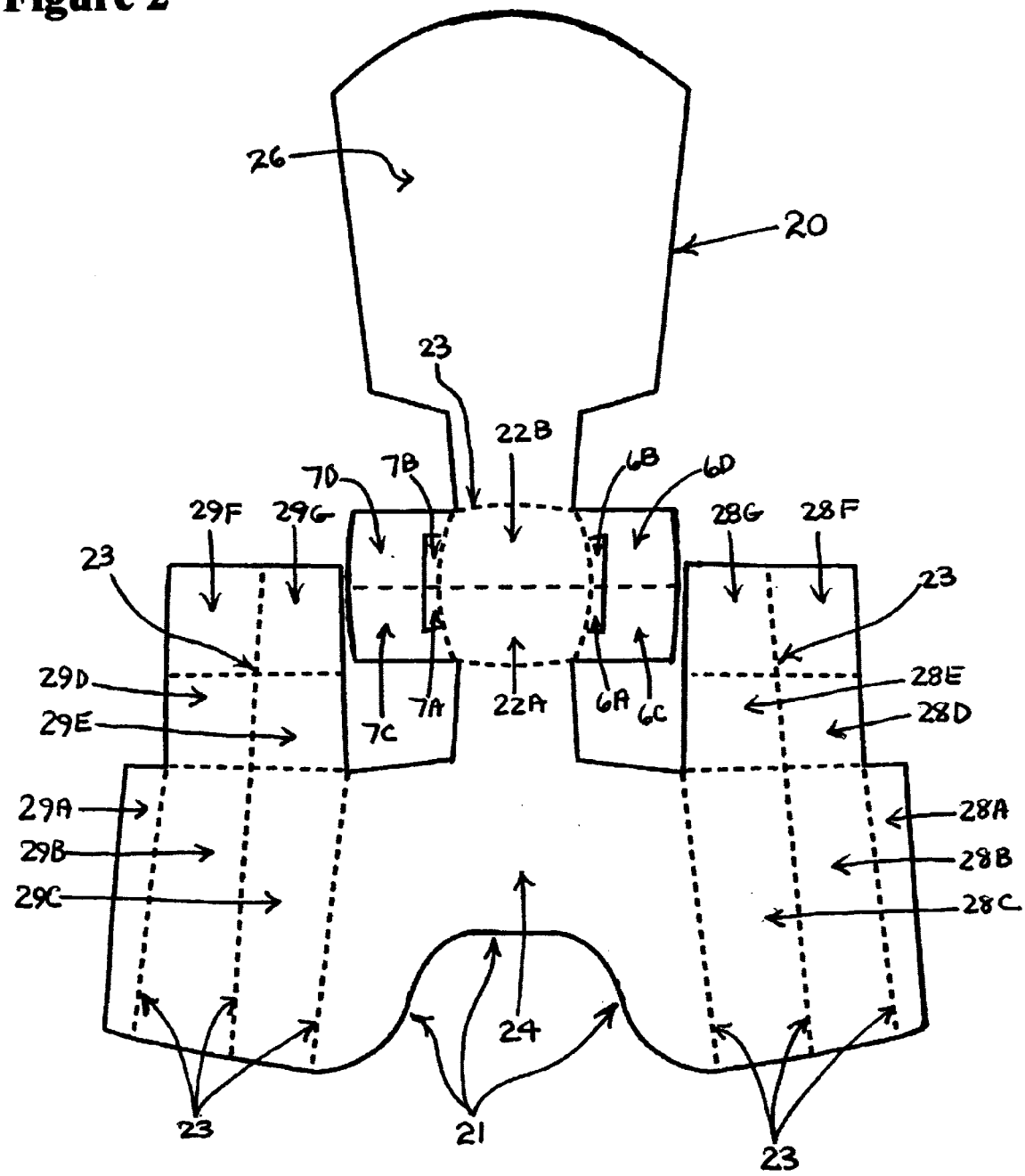
FIG. 2 is a planar view of a preferred embodiment of the inventive cup in an unfolded condition.
Figure 2A:
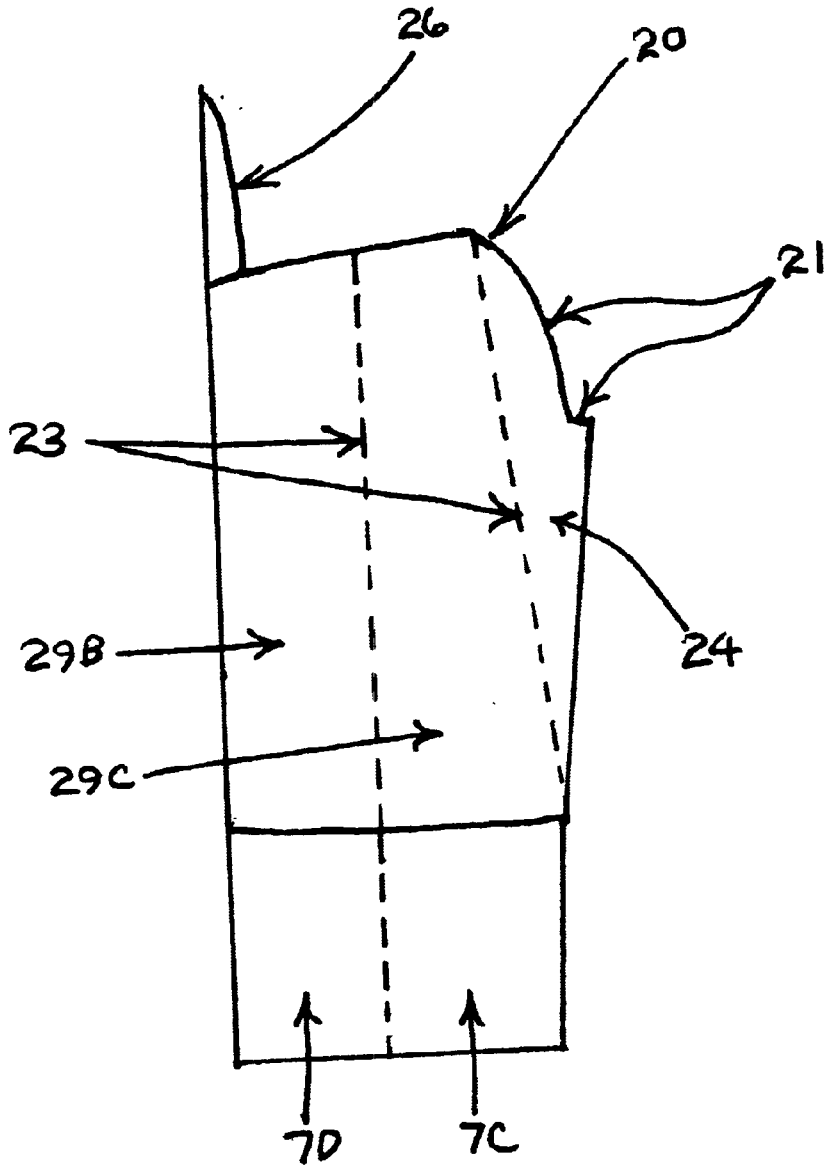
FIG. 2A is a perspective view of a preferred embodiment shown in FIG. 2 of the inventive cup in an expanded open cup shaped condition.

In the preferred embodiment as depicted in FIG. 2 and FIG. 2A, and generally designated by the numeral 20, one or more blanks of suitable material cut into the relative size and shape of the inventive cup 20 therein depicted are folded upon the scored fold lines 23 depicted in FIG. 2 and FIG. 2A as dashed lines and the edge panels 28A and 29A of the end wall panels 28B, 28C & 29B, 29C respectively and front and back side wall panels 24 & 26 respectively are attached to one another forming a folded cup 20 that fits in a cup holder. The folding cup 20 that fits in a cup holder's bottom is comprised of the two bottom panels 22A & 22B and is formed by folding along the scored fold lines 23 and the attachment of the end wall panels 28B, 28C & 29B, 29C and front and back side wall panels 24 & 26 respectively as described above which in turn further defines upon folding, the now when folded generally perpendicular bottom wall panels 6C, 6D & 7C, 7D and generally perpendicular bottom wall tabs 6A, 6B & 7A, 7B. Bottom wall tabs 6A, 6B & 7A, 7B in turn form a slit opening that provides a support for end wall bottom tabs 28F, 28G & 29F, 29G respectively such that the end wall bottom panels 28D, 28E & 29D, 29E when folded and in this supported position are generally perpendicular to the end wall panels 28B, 28C & 29B, 29C respectively and are also generally perpendicular to the end wall bottom tabs 28F, 28G & 29F, 29G respectively. The generally circular or polygonal bottom comprised of the two bottom panels 22A & 22B is collapsible along the scored fold lines 23 and once the end wall panels 28B, 28C & 29B, 29C of the collapsed folding cup 20 are squeezed together, the folding cup 20 expands forming an opening 21 and a generally circular or polygonal bottom comprised of the two bottom panels 22A & 22B of a size that will fit in a cup holder, such as those in use in automobiles.

The preferred embodiment as depicted in FIG. 2 in its open or expanded condition as depicted in FIG. 2A is of hollow, conical configuration, having an open bell-mouth 21 at one end, and a closed generally circular or polygonal bottom comprised of two bottom panels 22A & 22B at the opposite end. The folding cup 20 further includes opposed front and back side wall panels 24 and 26 respectively which are interconnected by means of opposed end wall panels 28B, 28C & 29B, 29C and overlying and being bonded to the opposed edges of the back side wall panel 26. As shown in FIG. 2 and FIG. 2A, the bell mouth opening 21 of the folding cup 20 facilitates the access to product, such as food items, and the generally circular or polygonal bottom comprised of two bottom panels 22A & 22B facilitates the use in a cup holder.

Figure 3:
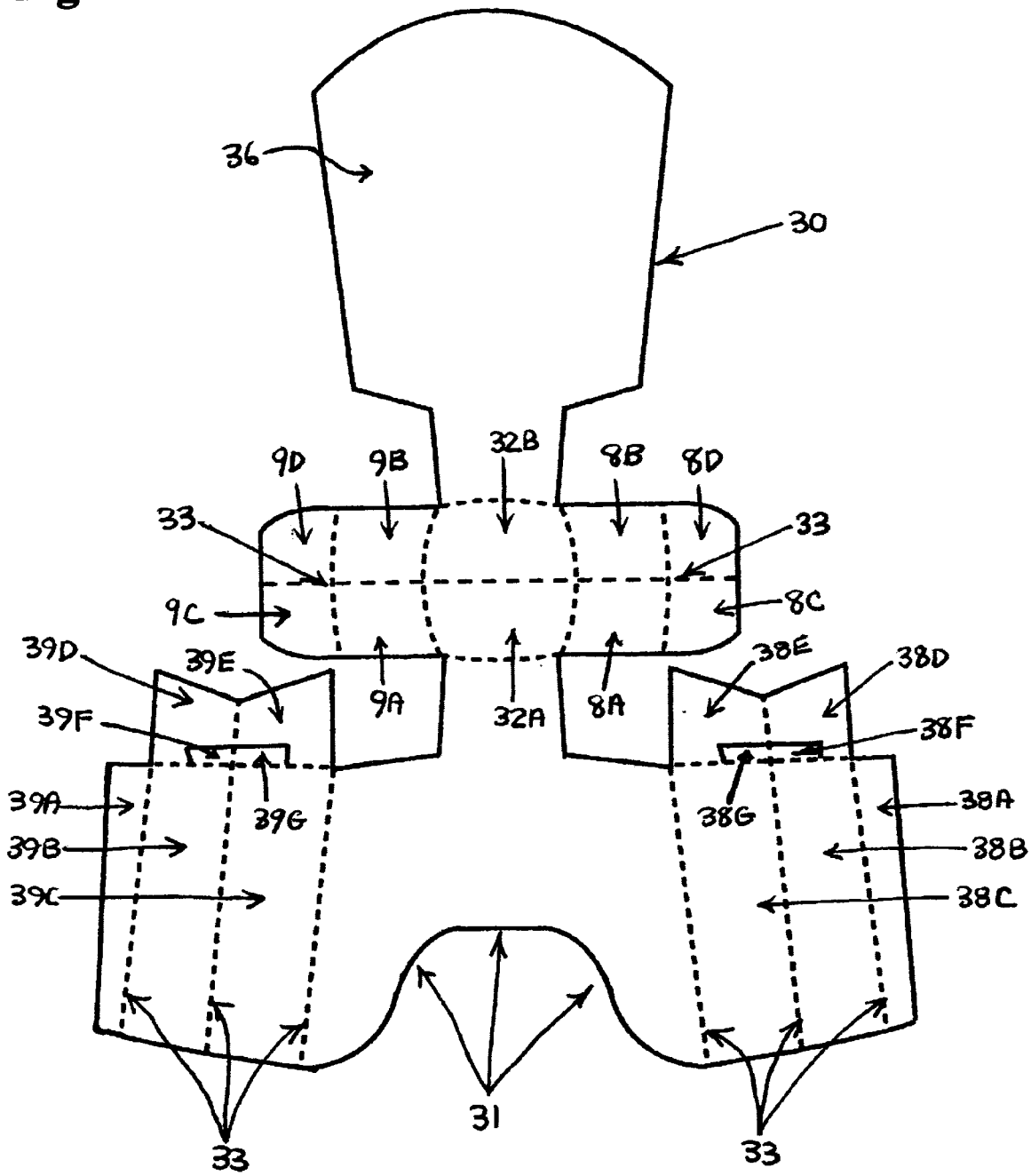
FIG. 3 is a planar view of another preferred embodiment of the inventive cup in an unfolded condition.
Figure 3A:
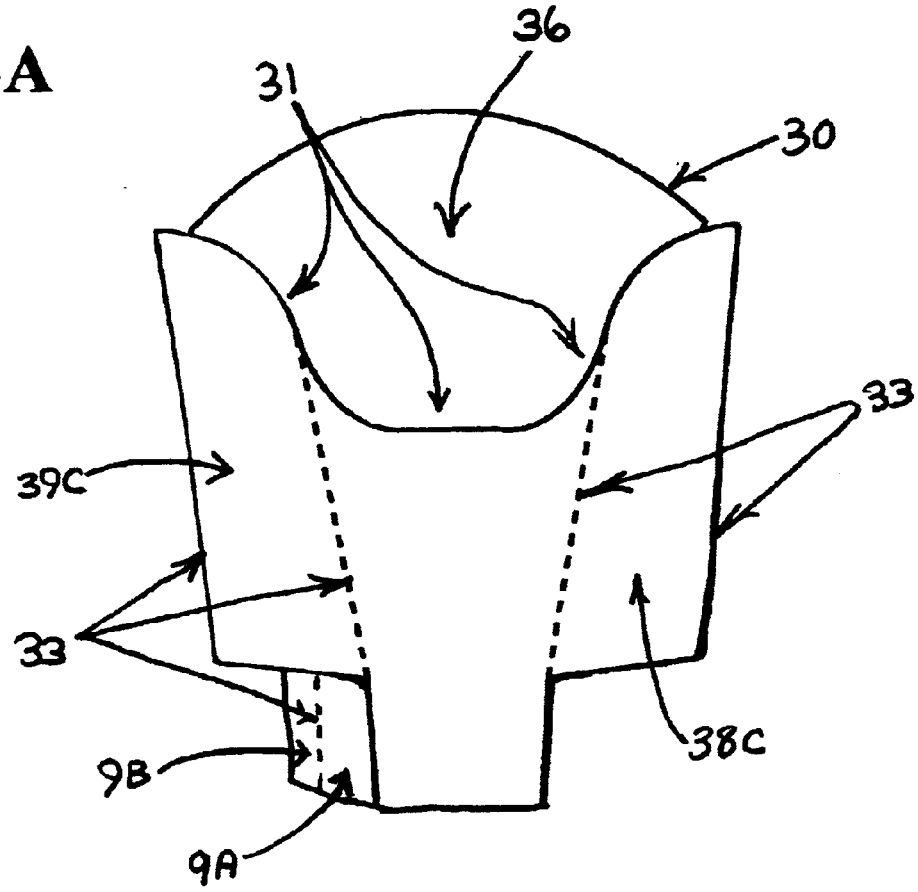
FIG. 3A is a perspective view of another preferred embodiment shown in FIG. 3 of the inventive cup in an expanded open cup shaped condition.

In another preferred embodiment as depicted in FIG. 3 and FIG. 3A, and generally designated by the numeral 30, one or more blanks of suitable material cut into the relative size and shape of the inventive cup 30 therein depicted are folded upon the scored fold lines 33 depicted in FIG. 3 and FIG. 3A as dashed lines and the edge panels 38A and 39A of the end wall panels 38B, 38C & 39B, 39C respectively and front and back side wall panels 34 & 36 respectively are attached to one another forming a folded cup 30 that fits in a cup holder. The folding cup 30 that fits in a cup holder's two bottom panels 32A & 32B is formed by folding along the scored fold lines 33 and attachment of the end wall panels 38B, 38C & 39B, 39C and front and back side wall panels 34 & 36 respectively as described above which in turn further defines upon folding, the now when folded generally perpendicular bottom wall panels 8A, 8B and 9A, 9B which in turn further defines upon folding, the now when folded generally perpendicular bottom wall support panels 8C, 8D and 9C, 9D respectively. Bottom wall support panels 8C, 8D and 9C, 9D insert into a slit opening and under the end wall bottom tabs 38D, 38E & 39D, 39E respectively and on top of the end wall lock tabs 38F, 38G & 39F, 39G respectively such that the end wall bottom tabs 38D, 38E & 39D, 39E and the end wall lock tabs 38F, 38G & 39F, 39G when folded and in this supported position are generally perpendicular to the end wall panels 38B, 38C & 39B, 39C respectively. The generally circular or polygonal bottom comprised of two bottom panels 32A & 32B is collapsible along the scored fold lines 33 and once the end wall panels 38B, 38C & 39B, 39C of the collapsed folding cup 30 are squeezed together, the folding cup 30 expands forming an opening 31 and a generally circular or polygonal bottom comprised of two bottom panels 32A & 32B of a size that will fit in a cup holder, such as those in use in automobiles.

The embodiment as depicted in FIG. 3 in its open or expanded condition as depicted in FIG. 3A is of hollow, conical configuration, having an open bell-mouth 31 at one end, and a closed generally circular or polygonal bottom comprised of two bottom panels 32A at the opposite end. The folding cup 30 further includes opposed front and back side wall panels 34 and 36 respectively which are interconnected by means of opposed end wall panels 38B, 38C & 39B, 39C and overlying and being bonded to the opposed edges of the back side wall panel 36. As shown in FIG. 3 and FIG. 3A, the bell mouth opening 31 of the folding cup 30 facilitates the access to product, such as food items, and the generally circular or polygonal bottom comprised of two bottom panels 32A & 32B facilitates the use in a cup holder.

Those who are skilled in the art will readily perceive various modifications which fall within the spirit and scope of the invention. Therefore, the claims that will be filed with the full patent application are to be construed to cover all equivalent structures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention the exact construction and operation shown and described, and accordingly, all suitable modifications and equivalents may be resorted to, falling within the scope of the invention.

What is claimed as being new and novel and desired to be protected by Letters Patent of the United States is as follows:

1. A folding cup comprising:

a top section having an open top end and an open bottom end;

the open bottom end of the top section having an attached shoulder portion;

a bottom section attached to the attached shoulder portion of the open bottom end of the top section wherein the bottom section is capable of holding user defined items therein which are placed into the top section through the open top end and then pass through the open bottom end into the bottom section;

the bottom section being a shape and size that fits into a holder capable of accepting and supporting a beverage can, bottle, or plastic or glass container;

the holder capable of accepting and supporting a beverage can, bottle, or plastic or glass container having an inside portion and an outer rim portion;

the attached shoulder portion of the top section being a shape and size that forms a rim wherein the rim is disposed in a generally perpendicular plane to the plane defining the general direction in which the bottom section is placed within the inside portion of the holder capable of accepting and supporting a beverage can, bottle, or plastic or glass container such that the rim is larger than the bottom section and will not fit into the holder capable of accepting and supporting a beverage can, bottle, or plastic or glass container allowing the rim to stabilize the folding cup once it is placed therein by resting the rim upon the outer rim portion of the holder capable of accepting and supporting a beverage can, bottle, or plastic or glass container;

the top section being capable of holding the user defined items therein which are placed into the top section through the open top end once the bottom section is filled with the user defined items; and the top section, the attached shoulder portion, the bottom section comprising the folding cup being collapsible to a generally flat folded condition.

2. A blank comprising:

a bottom panel;

the bottom panel having a front side, a back side, a left side and a right side;

at least one front side wall panel;

the front side wall panels having a front right end and a front left end;

the front side wall panels attached to the front side of the bottom panel;

at least one back side wall panel;

the back side wall panels having a back right end and a beck left end;

the back side wall panels attached to the back side of the bottom panel;

at least one right end wall panel attached to the front right end of the front side wall panels;

at least one left end wall panel attached to the front left end of the front side wall panels;

at least one right bottom wall panel attached to the right side of the bottom panel;

at least one left bottom wall panel attached to the left side of the bottom panel;

at least one right coupler attached to at least one of the right bottom wall panels;

at least one left coupler attached to at least one of the left bottom wall panels;

at least one right couplings acceptor means attached to the right end wall panels;

at least one left couplings acceptor means attached to the left end wall panels;

at least one right edge panel attached to the right end wall panels;

the right edge panels being further attached to the back right end of the back side wall panels;

at least one edge panel attached to the left end wall panels;

the left edge panels being further attached to the back left end of the back side wall panels;

the right couplings acceptor means being capable of coupling the right couplers and the left couplings acceptor means being capable of coupling the left couplers such that the blank is maintained in an open cup shaped condition when the right couplers and the left couplers are coupled thereby;

the blank being capable of being folded into a flat collapsed condition on scored fold lines and such that in an expanded condition the blank forms a container wherein the portion of the container comprised of the bottom panel, the right bottom wall panels and the left bottom wall panels fit into a bolder capable of accepting and supporting a beverage can, bottle, or plastic or glass container.

3. The blank as described in claim 2 wherein the bottom panel is generally circular in shape.

4. The blank as described in claim 2 wherein the bottom panel is polygonal in shape.

5. The blank as described in claim 2 wherein the right couplers are coupled by friction to the right couplers acceptor means and the left couplers are coupled by friction to the left couplers acceptor means.

6. The blank as described in claim 2 wherein the right couplers are comprised of a tab of a size and shape capable of being coupled by the right couplers acceptor means by use of a slit opening in the right couplers acceptor means and the left couplers are comprised of a tab of a size and shape capable of being coupled by the left couplers acceptor means by use of a slit opening in the left couplers acceptor means.

7. The blank as described in claim 2 wherein the holder is attached to an automobile.

8. The blank as described in claim 2 wherein the holder is attached to a truck.

9. The blank as described in claim 2 wherein the holder is attached to an airplane.

10. The blank as described in claim 2 wherein the bolder is attached to boat.

11. The blank as described in claim 2 wherein the blank in its expanded condition has a top opening large enough to allow the removal of product therefrom by the use of the human hand.

* * * * *